US008511240B1

(12) United States Patent
Strock

(10) Patent No.: US 8,511,240 B1
(45) Date of Patent: Aug. 20, 2013

(54) BABY VALET ASSEMBLY

(76) Inventor: David Strock, Amherst, NY (US)

( * ) Notice: Subject to any disclaimer, the term of this patent is extended or adjusted under 35 U.S.C. 154(b) by 0 days.

(21) Appl. No.: 13/455,807

(22) Filed: Apr. 25, 2012

(51) Int. Cl.
*A47B 57/00* (2006.01)

(52) U.S. Cl.
USPC ..... 108/98; 211/13.1; 211/85.7; 248/235; 248/231.71

(58) Field of Classification Search
USPC ..... 211/85.7, 88.01, 70.3, 13.1, 85.4, 211/126.1, 126.15, 133.6, 153, 134; 248/236, 248/220.1, 231.71, 228.6, 227.2, 235, 250; 108/90, 97, 98
See application file for complete search history.

(56) References Cited

U.S. PATENT DOCUMENTS 2,803,986 A * 8/1957 Choiniere et al. ..... 359/503
2,979,155 A * 4/1961 Scharfenberger ..... 182/222
3,706,105 A * 12/1972 Nicholas et al. ..... 5/93.1
4,561,549 A 12/1985 Yokohori
4,601,226 A * 7/1986 McClintock ..... 83/415
4,702,382 A * 10/1987 Hoshino ..... 211/134
4,879,955 A * 11/1989 Moll et al. ..... 108/50.02
5,177,899 A * 1/1993 Powell ..... 47/65.5
5,240,214 A * 8/1993 Birnbaum et al. ..... 248/231.41
5,429,252 A * 7/1995 Liu ..... 211/94.01
5,725,111 A * 3/1998 Choi ..... 211/119.1
5,873,311 A * 2/1999 Schlattl ..... 108/44
6,267,338 B1 * 7/2001 Saylor et al. ..... 248/200
6,439,521 B1 8/2002 Wilson et al.
7,376,993 B2 * 5/2008 Myers et al. ..... 5/655
2007/0023596 A1 2/2007 Bilsky

* cited by examiner

*Primary Examiner* — Korie H Chan
(74) *Attorney, Agent, or Firm* — Kloss, Stenger & LoTempio; Vincent G. LoTempio; David T. Stephenson

(57) ABSTRACT

A baby valet assembly that is removably attachable to a tabletop comprising a base structure having a mounting bar removably coupled to a means for attaching the base to a tabletop such as a retractable C-clamp and a tray having a substantially planar eating surface with a raised lip removably coupled to the mounting bar. The mounting bar is removably coupled to the tabletop for the purpose of providing a security post for a toy.

4 Claims, 2 Drawing Sheets

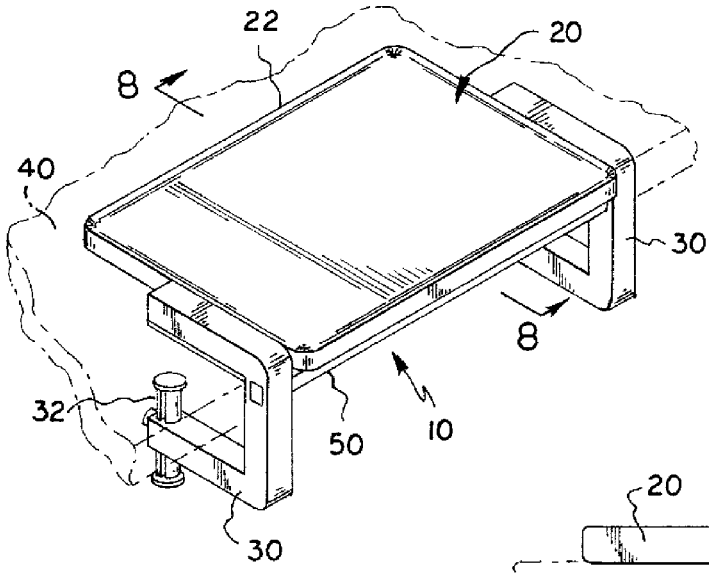
FIG. 1
FIG. 2
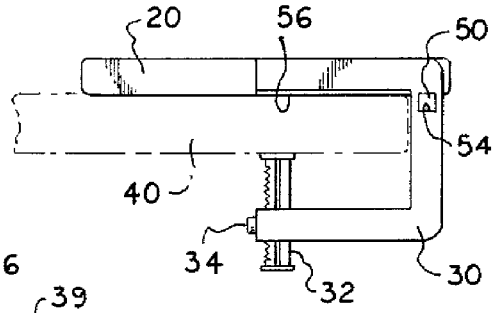
FIG. 4
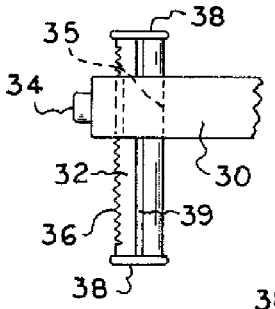
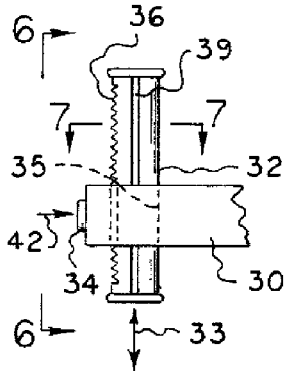
FIG 5
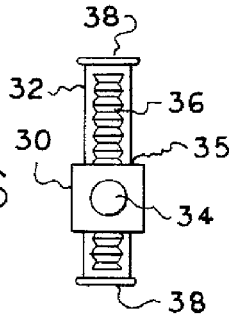
FIG. 6
FIG. 7
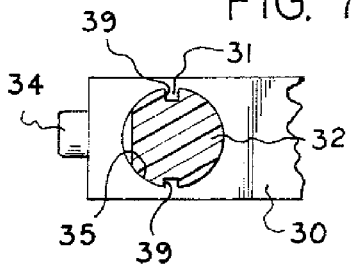

BABY VALET ASSEMBLY

BACKGROUND OF THE INVENTION

1. Field of the Invention

This invention relates to baby valet assemblies. More particularly, the present invention relates to a device that attaches to any existing table that can be selectively positioned to control the playing and eating environment of a child. More particularly, the present invention relates to an easily portable device having at least one element attached to and suspended from any table. The present invention has a clamping mechanism which is adaptable and adjustable for attaching to any table. The present invention has a table top/tray to ensure a sanitary play and eat area. The present invention relates to a suspended bar to which toys are hung and attached for a child's entertainment.

2. BACKGROUND

Several devices have been invented to facilitate child entertainment. For example, U.S. Pat. No. 4,561,549 issued to Yokohori, discloses an apparatus for supporting baby toys above a base by means of a tubular support structure having upwardly extending bars to which oblique bars are pivotally connected. However, the Yokohori patent does not describe a means for securing the bar to the edge of a table or tray. Moreover, Yokohori does not provide for the addition of a tray or table surface to be releasably mounted to a frame In, U.S. Patent Application No. 2007/0023596 by Adam Bilsky, discloses an apparatus to assist in retrieving toys that have fallen off of a table while also preventing fallen toys from contacting the ground. However, this apparatus is not used in conjunction with a horizontal bar to allow more freedom of movement of the toy and cannot alternatively be used as the base support of a tray used to protect an eating environment.

U.S. Pat. No. 6,439,521 issued to Wilson et al., discloses an apparatus for use with a baby stroller for supporting a cooling device, such as fan or spay bottle, so as to cool the infant sitting therein. The Wilson device presents a fan or spray bottle secured at the end of a horizontal bar and does not provide for a bar secured at each end that can be alternatively used as a support for the base of a tray top.

Thus it is readily apparent that there is a long felt need for an apparatus that allows for a portable, sanitary and removable means to attach a horizontal safety bar that alternatively is used as a base for a sanitary tray so that children are occupied and entertained at public eateries without compromising safety or health.

SUMMARY OF THE INVENTION

It is accordingly a primary object of the present invention to provide a sanitary eating surface and to prevent items from contacting the floor.

Another object of the invention is to provide a compact, versatile, hygienic and easy-to-use apparatus designed to attach to any table by way of an adjustable clamp system.

Yet another object of the invention is to provide a portable means of keeping a child occupied and amused while at eateries.

A further object of the invention is to provide an apparatus to which children's toys can be securely attached and readily available for their enjoyment.

Another further object of the invention is to provide a stable, sanitary surface on which a child's food, cups, toys and other accessories can be placed and secured.

The objects of the invention are achieved by provision of a baby valet assembly that is removably attachable to a tabletop comprising a base structure having a mounting bar removably coupled to a means for attaching the base to a tabletop such as a retractable C-clamp and a tray having a substantially planar eating surface with a raised lip removably coupled to the mounting bar. The mounting bar is removably coupled to the tabletop for the purpose of providing a security post for a toy.

Additional objects and advantages will become apparent and a more thorough and comprehensive understanding may be had from the following description and claims taken in conjunction with the accompanying drawings forming a part of this specification.

BRIEF DESCRIPTION OF THE DRAWINGS

The present disclosure and the manner in which it may be practiced is further illustrated with reference to the accompanying drawings wherein:

FIG. 1 is a front perspective view of a table top device of the present disclosure.

FIG. 2 is a side view of a C-clamp of the present disclosure showing the adjustable lock member, mounting bar and removable tray secured to a table.

FIG. 4 is a side view of the adjustable lock member and channel and partial view of the c-clamp of the present disclosure.

FIG. 5 is a side view of the adjustable lock member and channel and partial view of the C-clamp of the present disclosure being moved to secure against underside of the table.

FIG. 6 is a front view of the adjustable lock member, teeth and lock release button of the present disclosure, taken generally along line 6-6 in FIG. 5.

FIG. 7 is a cross section view of the C-clamp of the present disclosure, taken generally along line 7-7 in FIG. 5.

DETAILED DESCRIPTION OF THE INVENTION

Figure 3:
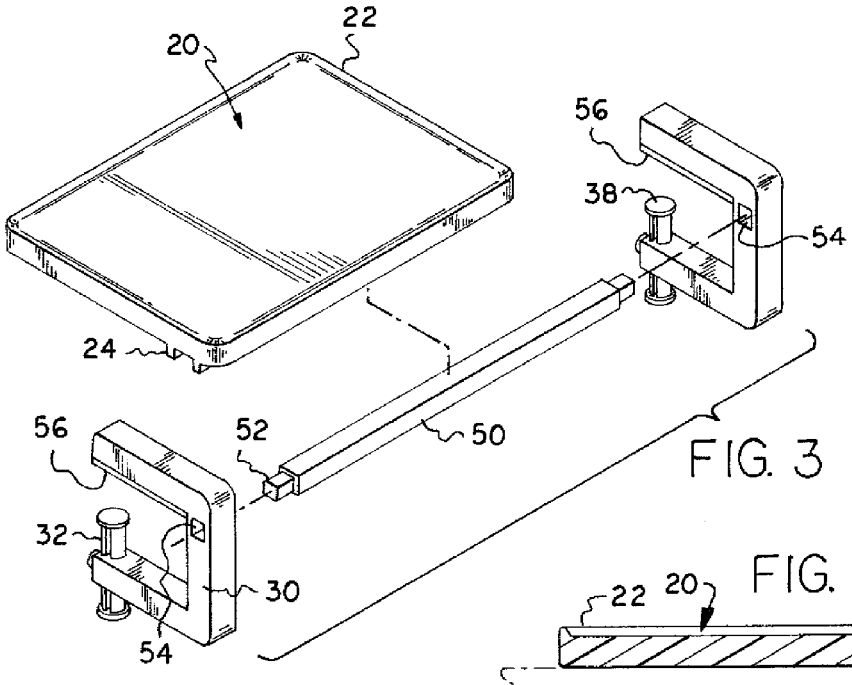
FIG. 3 is a partial exploded view of the tray, mounting bar, and C-clamp devices of the present disclosure.

At the outset, it should be clearly understood that like reference numerals are intended to identify the same structural elements, portions, or surfaces consistently throughout the several drawing figures, as may be further described or explained by the entire written specification of which this detailed description is an integral part. The drawings are intended to be read together with the specification and are to be construed as a portion of the entire "written description" of this invention as required by 35 U.S.C. §112.

Adverting now to the drawings, with reference to FIG. 1, a preferred embodiment of the present disclosure of a baby valet assembly that is removably attachable to a tabletop is indicated generally by numeral 10 comprising a base structure having a mounting bar removably coupled to a means for attaching the base to a tabletop and a tray having a substantially planar eating surface removably coupled to the mounting bar. FIG. 1 illustrates a rectangular removable tray 20 with raised lip 22. Tray 20 is made from PVC and is removably attached to mounting bar 50 so as to allow for easy removal and attachment to provide a sanitary table top environment in a public place. For purposes of this illustration, tray 20 is a substantially planar eating surface of a generally rectangular shape but it should be readily apparent to those of ordinary skill in the art that tray 20 could be made in the shape of any other shape such as a curved tray, a polyhedron, a triangular or other similar shape; however, each embodiment of tray 20 should maintain soft edges that will not injure the user, as this is essential to the safe use of the present disclosure. Tray 20 is further equipped with lip 22 which is a spill retention rim encircling the substantially planar eating surface of tray 22 so as to limit the ability of objects to fall over the edge of the tray.

FIG. 1 further illustrates the base which is comprised of mounting bar 50 and the means for attaching the base to a tabletop as generally shaped C-clamps 30, with the open end of the 'C' positioned around the table 40. The C-clamps provide an easy removable means to secure mounting bar 50 to a stationary flat surface in this case table 40. Mounting bar 50 attaches to table 40 by using a cylindrical PVC adjustable lock member, indicated by numeral 32, which allows the securing means of the C-clamp to adjust and clamp to tables of varying width. The baby valet assembly is multifunctional a device used for child entertainment and an alternative eating surface area. When sitting at a table with a young child in a highchair or booster seat, adults will often times give the child certain toys or other playthings for the purpose of entertainment or to occupy the child's attention. Frequently, the child will be quite young and lack the manual dexterity required to grasp the particular object for more than a few moments. Other times, the child may deliberately toss the object. In either situation, the toy will typically fall off the table and onto the floor. The adult typically has to reach down or get up from where they are seated in order to retrieve the fallen object. This scenario can sometimes continuously repeat itself numerous times and can cause the adult great frustration. In addition, the fallen toy may become damaged or dirtied from coming in contact with the ground such that it would not be suitable for further play, thus causing the child to become restless or irritated.

Mounting bar 50 can be used as a child entertainment facilitator by removably securing a PVC mounting bar 50 to the table top by using two C-clamps 30 connected to each end of mounting bar 50. Mounting bar 50 serves as a base to secure a child's toy in such a manner that a toy cannot be thrown to the floor. Additionally the marriage of C-clamp 30 to mounting bar 50 allows for additional stability. In addition, rectangular tray 20 is removably attached and aligned along C-clamps 30 parallel to table 40 providing sanitary, adjustable and removable surface for child to eat in an alternative configuration of the instant disclosure.

FIG. 2 illustrates a side view of C-clamp 30 of the present disclosure showing cylindrical-shaped adjustable lock member 32, mounting bar 50 and tray 20 secured to a table 40. Tray 20 is form fitting to its designated space sitting parallel to table 40 to which mounting bar 50 is secured. Mounting bar 50 is secured to table 40 using C-clamps 30 which fit around and slides onto table 40. The height of the bar is adjusted using adjustable lock member 32. Adjustable locking member 32 is an adjustable means to secure a baby valet assembly to any size table. FIG. 2 illustrates adjustable lock member 32 extended and securely engaged to underside of table 40. Adjustable lock member 32 is released using lock button release 34, which is located at the open end of C-clamp 30. Lock button release 34 is spring loaded allowing for easy attachment and release of adjustable lock member 32. FIG. 2 illustrates mounting bar 50 secured to C-clamp 30. FIG. 2 illustrates how mounting bar 50 attaches and secures within aperture 54, at closed end of C-clamp 30. FIG. 2 represents mounting bar sits directly under tray 20 and provides additional stability to secure present invention to table 40 by acting as a brace against the edge of table 40.

FIG. 3 is a partial exploded view of tray 20, mounting bar 50, and C-clamp 30 of the present disclosure. FIG. 3 illustrates tray 20 have raised lip 22. Lip 22 is an edge around the entirety of tray 20 and prevents spillage off tray 20. FIG. 2 also depicts two flexible columns, indicated by number 24, on the underside of tray 20. Flexible columns 24 removably attaches to mounting bar 50 thus removably securing tray 20 into position parallel to surface of table 40 to prevent tray movement when a child is playing or eating. FIG. 3 further illustrates C will-clamps 30 which slide onto table surface and secure using adjustable lock members 32 which are removed we mounted in each hole 54 in the C-clamps. Each adjustable lock member 32 features a circular stop rubber grip pad, indicated by numeral 38 at the top of adjustable lock member 32. Stop rubber grip pad 38 and rubber pad 56, provide additional measure of stability as the rubber prevents secured C-clamp from sliding along table surface. Stop rubber grip pad 38 rests along bottom of table, while rubber pad 56 runs along the underside of the top of C-clamp 30 and rests along top of the table. Stop rubber grip pad 38 and rubber pad 56 also prevent the device from scratching surface of table. FIG. 3 illustrates square aperture, indicated by numeral 54 on each C-clamp 30. Aperture 54 provides square slot in which a polyhedron clamp insert, indicated by numeral 52, attached to each end of mounting bar 50 slides into and secures providing a secure means by which to attach a child's toy.

FIG. 4 illustrates a side view of adjustable lock member 32, channel 39, and partial view of C-clamp 30 of the present disclosure. Adjustable lock member 32 attaches to the C-clamps by insertion through hole 35, the hole in C-clamp 30 is slightly wider than circumference of adjustable lock member 32, which is cylinder-shaped with depressed channel 39 running vertically down the center of the lock member. Channel 39 in adjustable lock member 32 works in conjunction with a protrusion in the aperture on each C-clamp locking adjustable lock member into place and preventing the lock member from twisting. Adjustable lock member 32 is released using a spring loaded lock and by pushing lock button release 34 located at the open end of c-clamp 30 to the left of adjustable lock member 32. Teeth 36, run along one edge of adjustable lock member 32 and allow adjustable lock member 32 to be secured into the desired position. Teeth 36 allow the C-clamp to maintain the desired position by marrying with adjustable lock member 32 and lock button release 34. FIG. 4 depicts the top and bottom of adjustable lock member 32 provided with a circular stop rubber grip pad 38. Stop rubber grip pad 38 provides a rubber surface adjacent to the bottom of the table preventing the C-clamps from disengaging from the table surface. Additionally, stop rubber grip pad 38 located on the bottom of adjustable lock member 32 provides stability when the present invention is set on a surface but not attached to a table using C-clamps 30.

FIG. 5 illustrates a side view of adjustable lock member 32 and channel 39 and partial view of C-clamp 30 of the present. Adjustable lock member 32 attaches to the present invention through hole 35, in C-clamp 30. Adjustable lock member 32 is cylinder-shaped with channel 39, running vertically down the center of adjustable lock member 32. Adjustable lock member 32 is released using a spring loaded lock and by pushing lock button release 34 located at the open end of C-clamp 30 proximate adjustable lock member 32. Teeth 36, run along the edge of adjustable lock member 32 facing lock button release, and allow adjustable lock member 32 to lock into the desired position. Teeth 36 engage with lock button release 34 to adjustably maintain a variety of desired positions. FIG. 5 further illustrates the functionality of the of adjustable lock member 32 and C-clamp 30. Lock member 32 is capable of upward and downward movement, as indicated by arrow 33, through circular hole 35 in C-clamp 30. To initiate this movement lock button release 34 must be engaged and pushed in the general direction of arrow 42. This movement allows the C-clamps to adapt to various table dimensions while ensuring adjustable lock member 32 will be positioned flush against the underside of the table.

FIG. 6 illustrates a front view of the adjustable lock member, teeth and lock button release of the present invention. The cylindrical adjustable lock member 32 is inserted and married to C-clamp 30 through circular hole 35 in C-clamp 30. On the open end of C-clamp 30 is lock button release 34 which when engaged allows adjustable lock member 32 to slide either up or down allowing it to attach securely to any table. To ensure a secure grip between the table and adjustable lock member 32, stop rubber grip pads 38 are located on each end of the adjustable lock member 32. Stop rubber grip pads 38 prevent the present invention from disengaging once secured to the table. FIG. 6 illustrates another mechanism to ensure stability, teeth 36 on the adjustable lock member 32. Jagged teeth 36 marry with C-clamp 30 and spring loaded lock when lock button release 34 is not engaged. Teeth 36 allow for secure closure that can only be released when lock button release 34 is pushed in and engaged allowing adjustable lock member 32 to slide freely through C-clamp 30 without teeth 36 locking into a secure position preventing movement.

FIG. 7 is a cross sectional view of the C-clamp of the present disclosure, taken generally along line 7-7 in FIG. 5. C-clamp 30 has circular hole 35 through which adjustable lock member 32 passes through. Circular hole 35 has tongues 31 protruding from and along the length of the sides of hole 35. Tongues 31 marries with channels 39 on adjustable lock member 32 allowing the present invention to remain in the desired position. Tongue 31 and channel 39 provide stability preventing present invention from twisting while in use. Tongue 31, channel 39, C-clamp 30 work in concert to allow adjustable lock member 32 to transverse upward or downward when the lock button release 34 is engaged. The upward or downward movement of the lock members allows the C-clamps to adjust to various table sizes and mate securely with the table surface.

Figure 8:
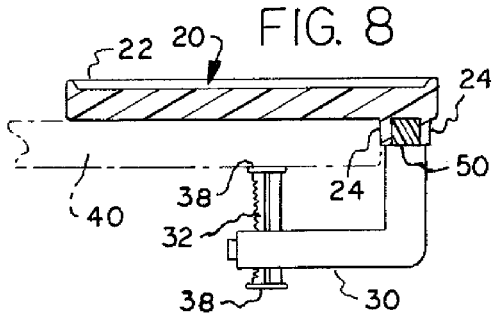
FIG. 8 is a cross-sectional view showing C-clamp and tray of present disclosure attached to a table top, taken generally along line 8-8 in FIG. 1.

FIG. 8 is a cross-sectional view showing C-clamp and tray of present disclosure attached to a table top, taken generally along line 8-8 in FIG. 1. FIG. 8 illustrates the present invention secured to table 40. Closed end of C-clamp 30 is positioned flush with table 40. Adjustable lock member 32 protrudes out of the open end of C-clamp 30 to lock securely against underside of table 40. Stop rubber grip pad 38 ensures the present invention will not slide along underside of table 40. FIG. 8 also illustrates tray 20 held securely in place by C-clamps 30. Tray 20 rests parallel to table 40. Tray 20 features lip 22 to prevent spillage from tray 20. Along underside of tray 20 are flexible columns 24 which removably couple with mounting bar 50. FIG. 8 shows mounting bar 50 securely positioned in aperture 54. Mounting bar 50 is flush against one edge of table 40 providing additional stability for the tray. With tray 20 secured to mounting bar 50 using flexible columns 24, mounting bar 50, provides stability for tray 20.

Figure 9:
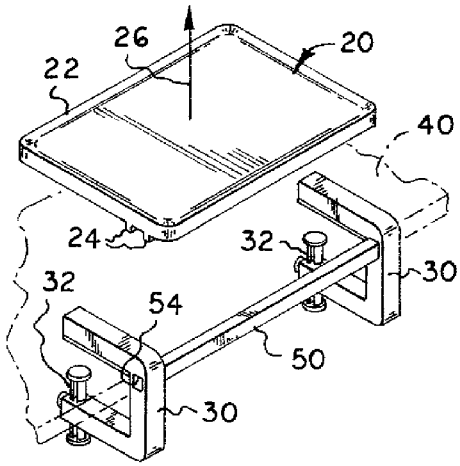
FIG. 9 is a partial exploded view of the tray of the present disclosure being unclipped and removed from the mounting bar and C-clamps.

FIG. 9 illustrates a partial exploded view of the tray of the present invention being unclipped and removed from the mounting bar and C-clamps. FIG. 9 shows tray 20 detached from mounting bar 50 in the general direction of arrow 26. The rectangular tray 20 with lip 22 is used as a eating and play surface for the child. FIG. 9 illustrates tray 20 removed in the general direction of arrow 26 from mounting bar 50 which remains secured to the table 40. FIG. 9 illustrates retractable C-clamps 30 secured to table 40 through the extension of adjustable lock members 32. With tray 20 removed, the mounting bar remains securely affixed to table 40. Mounting bar 50 extends across connecting C-clamps 30. Mounting bar is secured through aperture 54 in each C-clamp 30. FIG. 9 illustrates mounting bar 50 fully exposed and not covered by tray 20. FIG. 9 illustrates the portability and versatility of the present invention. FIG. 9 represents the various functionality of the present invention allowing it to operate as both a sanitary eating surface and a security post for a toy.

Figure 10:
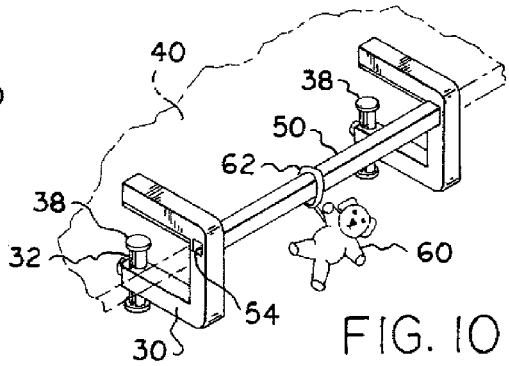
FIG. 10 is a perspective view of mounting bar of the present disclosure used to secure toy while attached to a table.

FIG. 10 is a perspective view of mounting bar of the present invention being used to secure toy while attached to a table. FIG. 10 shows the mounting bar in operation without tray 20 (not shown in FIG. 10). FIG. 10 illustrates the present invention attached to table 40. C-clamps 30 are positioned secured to table 40. Adjustable lock members 32 are extended flush against underside of table 40. Stop rubber grip pads 38 provide stability and friction between adjustable lock member 32 and underside of table 40. Mounting bar 50 is suspended parallel to the edge of table 40 from C-clamps 30. FIG. 10 shows mounting bar 50 raised above and away from table 40, allowing for space between table 40 and mounting bar 50. FIG. 10 depicts a toy 60 hanging from hook 62 attached to mounting bar 50. Toy 60 is suspended from mounting bar 50 allowing a child to freely play with the toy. The position of the mounting bar allows a toy to swing 360 degrees around mounting bar 50 while remaining attached. Hook 62 prevents toy 60 from falling to the ground. A toy secured to a mounting bar eliminates the problem of a toy falling to the ground and the situation of a parent having to retrieve fallen toys. Mounting bar 50 and hook 62 allow a child to slide toy 60 across length of mounting bar 50 providing additional entertainment. Mounting bar 50 is affixed to C-clamps 30 through apertures 54 which secure mounting bar 50 to the present invention. Secure mounting bar 50 is preferably straight edged and generally cylindrical in shape and provides multiple attachment uses from various existing toys with attachment hooks, as FIG. 10 illustrates a stationary mounting bar to which a toy with an attachment hook is attached.

Although the invention as been described with reference to certain preferred embodiments, it will be appreciated by those skilled in the art that modifications and variations may be made without departing from the spirit and scope of the invention. It should be understood that applicant does not intend to be limited to the particular details described above and illustrated in the accompanying drawings. In this regard, the term "means for" as used in the claims is intended to include not only the designs illustrated in the drawings of this application and the equivalent designs discussed in the text, but it is also intended to cover other equivalents now known to those skilled in the art, or those equivalents which may become known to those skilled in the art in the future.

What is claimed is:

1. A baby valet assembly that is removably attachable to a tabletop comprising: a base structure having a mounting bar removably coupled to a mean for attaching said base to said tabletop; wherein said means for attaching said base to said tabletop are retractable C-clamps; said retractable C-clamps comprise of an adjustable lock member and an aperture; said adjustable lock member comprises a stop rubber grip pad, a rubber pad, teeth and a lock button release; said stop rubber grip pad and said rubber pad, provide stability as said stop rubber grip pad and said rubber pad prevent and secure said retractable C-clamps from sliding along said tablet; said teeth run along one edge of said adjustable lock member and allow said adjustable lock member to be secured into a desired position by said teeth marrying with said adjustable lock member and said lock button release; said lock button release is spring loaded to allow for easy attachment and release of said adjustable lock member; said aperture is located at a closed end of said retractable C-clamps, wherein said mounting bar attaches and secures within said aperture; said mounting bar provides as a security post for a toy and partially supports a tray; and said tray has a substantially planar eating surface removably coupled to said mounting bar, wherein said tray is also partially supported from said tabletop, as said tray is partially in contact with said tabletop.

2. The baby valet assembly of claim 1 wherein said tray having a substantially planar eating surface has two flexible columns for removably coupling said tray to said mounting bar.

3. The baby valet of claim 2 wherein said tray has a retention lip encircling said substantially planar eating surface.

4. The baby valet assembly of claim 1 wherein said mounting bar is cylindrical.

* * * * *